US007586457B2

(12) United States Patent
Qi et al.

(10) Patent No.: US 7,586,457 B2
(45) **Date of Patent: *Sep. 8, 2009**

(54) BALANCED DIPOLE ANTENNA

(75) Inventors: Yihong Qi, Waterloo (CA); Perry Jarmuszewski, Guelph (CA); Paul Dullaert, Kitchener (CA)

(73) Assignee: Research In Motion Limited, Waterloo, Ontario (CA)

( * ) Notice: Subject to any disclaimer, the term of this patent is extended or adjusted under 35 U.S.C. 154(b) by 194 days.

This patent is subject to a terminal disclaimer.

(21) Appl. No.: 11/725,733

(22) Filed: Mar. 20, 2007

(65) Prior Publication Data

US 2007/0182656 A1 Aug. 9, 2007

Related U.S. Application Data

(63) Continuation of application No. 10/984,699, filed on Nov. 9, 2004, now Pat. No. 7,193,579.

(51) Int. Cl.
*H01Q 9/16* (2006.01)

(52) U.S. Cl. ..... 343/821; 343/793; 343/820

(58) Field of Classification Search ..... 343/821, 343/793, 820, 822, 823
See application file for complete search history.

(56) References Cited

U.S. PATENT DOCUMENTS 2,473,328 A * 6/1949 Brown et al. ..... 343/821
4,319,249 A * 3/1982 Evans et al. ..... 343/703
5,936,590 A * 8/1999 Funder ..... 343/795
5,977,842 A * 11/1999 Brown et al. ..... 333/26
6,239,755 B1 * 5/2001 Klemens et al. ..... 343/702
6,778,099 B1 * 8/2004 Meyer et al. ..... 340/870.02
6,940,264 B2 * 9/2005 Ryken et al. ..... 324/95

* cited by examiner

*Primary Examiner*—HoangAnh T Le
(74) *Attorney, Agent, or Firm*—Ridout & Maybee LLP

(57) ABSTRACT

A balanced dipole antenna has a coaxial cable connected between a load or source and the left and right dipole arms to substantially eliminate common mode current and radiative coupling between the coaxial cable and the left and right dipole arms. The connection between the source/load coaxial cable and the left and right dipole arms is a symmetric balun having a center branch that is an extension of the source/load coaxial cable, and left and right stubs. When the stubs are segments of coaxial cable, the outer conductors of the left and right stubs of the symmetric balun are respectively coupled to the left and right dipole arms, and one of the inner conductors of the left and right stubs is connected to the inner conductor of the center branch, while the other of the inner conductor of the left and right stubs is connected to the outer conductor of the center branch. When the stubs are metallic, the inner conductor of the center branch is electrically connected to one of the left and right dipole arms, while the outer conductor of the center branch is electrically connected to the other of the left and right dipole arms. A sliding bar at the base of the stubs electrically connects the outer conductors of the left and right stubs and the center branch.

17 Claims, 4 Drawing Sheets

BALANCED DIPOLE ANTENNA

BACKGROUND OF THE INVENTION

The present invention relates a balanced dipole antenna, and more particularly, is directed to a symmetric balun used with a coaxial cable and dipole antenna.

FIG. 1 shows dipole antenna 10 as having coaxial cable 5 having outer coaxial conductor 15 and inner coaxial conductor 16 used with a dipole antenna having dipole left blade 11 and dipole right blade 12. Coaxial outer conductor 15 is connected to dipole right blade 12. Coaxial inner conductor 16 is connected to dipole left blade 11 via wire 17.

As used herein and in the claims, "coupling" includes a radiative connection and a direct electrical connection.

Since an isotropic antenna is physically impossible, antenna gain is measured against a standard dipole antenna, and the results are indicated as decibels vs. dipole (dBd).

Common mode current flows on the outside of the coaxial line, reducing the efficiency of a pure dipole radiation pattern. Additionally, common mode current is caused by radiative coupling between the dipole antenna and an external coaxial cable. The majority of the distortion of the dipole antenna pattern is due to common mode current flow caused by the conducting imbalance of the structure, and a smaller amount of the distortion is due to radiative coupling.

To reduce the common mode current flow, a balun is used. A balun acts as a transformer, connecting a balanced two-conductor line to an unbalanced coaxial line.

FIG. 2 shows dipole antenna 30 as having coaxial cable 5 connected to a dipole antenna using Roberts balun 40. The dipole antenna forms a balanced load (or source). Coaxial cable 5 connects to an unbalanced source (or load) and is connected to Roberts balun 40 at connection 41 which may be a threaded screw-type connection. Roberts balun 40 has a main coaxial segment having outer coaxial conductor 45 and inner coaxial conductor 46. Coaxial outer conductor 45 is connected to dipole right blade 32. Roberts balun 40 also has a short coaxial cable segment having outer conductor 35 and inner conductor 36. Roberts balun 40 is a quarter wavelength current choke. Coaxial outer conductor 35 is connected to dipole left blade 31. Coaxial inner conductors 35 and 45 are connected at their top ends via wire 37 and coupled to dipole left blade 31.

Sliding bar 38 connects the bottom end of coaxial outer conductor 35 to coaxial outer conductor 45. Sliding bar 38 creates a short circuit, providing an infinite impedance across the terminals of dipole left arm 31 and dipole right arm 32.

FIG. 3 shows dipole antenna 50 as having coaxial cable 5 coupled to a dipole antenna using IEEE-type balun 50, sometimes referred to as a Type III balun. The dipole antenna forms a balanced load (or source). Coaxial cable 5 connects to an unbalanced source (or load) and is connected to IEEE-type balun 50 at connection 51 which may be a threaded screw-type connection. IEEE-type balun 50 has a main coaxial segment having outer coaxial conductor 65 and inner coaxial conductor 66. Coaxial outer conductor 65 is electrically connected to dipole right blade 52. Coaxial inner conductor 66 is electrically connected to dipole left blade 51 via wire 57. IEEE-type balun 50 also has conductor 55 electrically connected to dipole left blade 51. IEEE-balun 50 is a quarter wavelength current choke. Conductor 55 is located generally parallel to the coaxial cable. Sliding bar 58 connects the bottom end of conductor 55 to coaxial outer conductor 65.

Sliding bar 58 creates a short circuit, providing an infinite impedance across the terminals of dipole left arm 51 and dipole right arm 52.

The quarter wavelength current choke in each of FIGS. 2 and 3 serves to reduce common mode current. However, conventional baluns used with dipole antennas do not prevent radiative coupling between a coaxial cable and the dipole antenna and do not completely eliminate common mode current. Accordingly, there is room for an improved coupling between a coaxial cable and a dipole antenna.

SUMMARY OF THE INVENTION

In accordance with an aspect of this invention, there is provided a balanced dipole antenna, comprising a left dipole arm having a center end, a right dipole arm having a center end, a coaxial cable having an outer conductor and a single inner conductor and a top end electrically located between the center ends of the left and right dipole arms, a left stub coupling the left dipole arm and the coaxial cable, and a right stub coupling the right dipole arm and the coaxial cable.

The structure of the balanced dipole antenna substantially eliminates radiative coupling between the coaxial cable and the left and right dipole arms, and substantially eliminates common mode current between the coaxial cable and the left and right dipole arms.

In a further aspect of this invention, the left and right stubs are formed of respective lengths of coaxial cable. In this case, one of the left and right stubs has an inner conductor that electrically connects to the inner conductor of the coaxial cable, and the other of the left and right stubs has an inner conductor that electrically connects to the outer conductor of the coaxial cable.

In yet a further aspect of this invention, the left and right stubs are formed of metallic material. In this case, the inner conductor of the coaxial cable is connected to one of the left and right dipole arms, and the outer conductor of the coaxial cable is connected to the other of the left and right dipole arms.

In accordance with another aspect of this invention, a dipole antenna comprises a left dipole arm, a right dipole arm, a coaxial cable, and means for coupling the coaxial cable to the left and right dipole arms to substantially eliminate common mode current and radiative coupling between the coaxial cable and the left and right dipole arms.

In accordance with yet another aspect of this invention, there is provided a symmetric balun, comprising a left stub for coupling to a left arm of a dipole antenna, a right stub for coupling to a right arm of a dipole antenna, and a center branch for connecting to a coaxial cable, the center branch having an inner conductor and an outer conductor.

It is not intended that the invention be summarized here in its entirety. Rather, further features, aspects and advantages of the invention are set forth in or are apparent from the following description and drawings.

DETAILED DESCRIPTION

Figure 4:
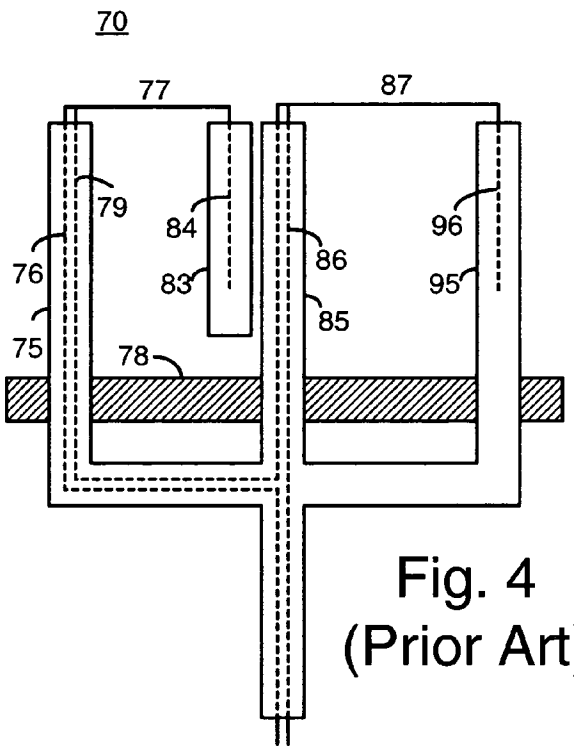
Fig. 4 (Prior Art)
FIG. 4 is a diagram showing a prior art candelabra balun and transformer.

FIG. 4 shows a prior art candelabra balun and transformer 70 fed by a special twin lead cable having outer conductor 85 and two inner conductors. The twin lead cable forms the center branch of a candelabra structure, which also has a left branch having left outer conductor 75 and a right branch having right outer conductor 95.

Left outer conductor 75 and right outer conductor 95 are electrically connected to outer conductor 85 below sliding bar 78. Sliding bar 78 creates a short circuit between outer conductors 75, 85, 95.

A central segment having outer conductor 78 is located at the center of the candelabra structure next to the top of outer conductor 85. The bottom of outer conductor 78 is not electrically connected to sliding bar 78.

Inner conductor 86 of the twin lead cable continues to the top of outer conductor 85.

Inner conductor 76 of the twin lead cable feeds into the left branch of the candelabra structure.

Conductor 79 has a U-shape and is located inside the left branch of the candelabra structure and inside the center branch of the candelabra structure.

The right branch of the candelabra structure has inner conductor 96.

The central segment of the candelabra structure has inner conductor 84.

Wire 77 couples inner conductors 76 and 79 of the left branch of the candelabra structure to inner conductor 84 of the central segment of the candelabra structure.

Wire 87 couples inner conductors 86 and 79 of the special twin lead cable forming the center branch of the candelabra structure to inner conductor 96 of the right branch of the candelabra structure.

Candelabra balun and transformer 70 provides a transformation ratio of 4:1. Adding more branches, namely a total of three arms on each side of the center branch, provides a transformation ratio of 9:1. A total of arms on each side of the center branch, provides a transformation ratio of 16:1.

Embodiments of a balanced dipole antenna will now be discussed.

A balanced dipole antenna has a coaxial cable connected between a load or source and the left and right dipole arms to substantially eliminate common mode current and radiative II coupling between the coaxial cable and the left and right dipole arms. The connection between the source/load coaxial cable and the left and right dipole arms is a symmetric balun having a center branch that is an extension of the source/load coaxial cable, and left and right stubs.

When the stubs are segments of coaxial cable, the outer conductors of the left and right stubs of the symmetric balun are respectively coupled to the left and right dipole arms, and one of the inner conductors of the left and right stubs is connected to the inner conductor of the center branch, while the other of the inner conductor of the left and right stubs is connected to the outer conductor of the center branch.

When the stubs are metallic, the inner conductor of the center branch is electrically connected to one of the left and right dipole arms, while the outer conductor of the center branch is electrically connected to the other of the left and right dipole arms. A sliding bar at the base of the stubs electrically connects the outer conductors of the left and right stubs and the center branch.

A dipole antenna using a first embodiment of a symmetric balun according to the present invention will now be discussed.

Figure 5:
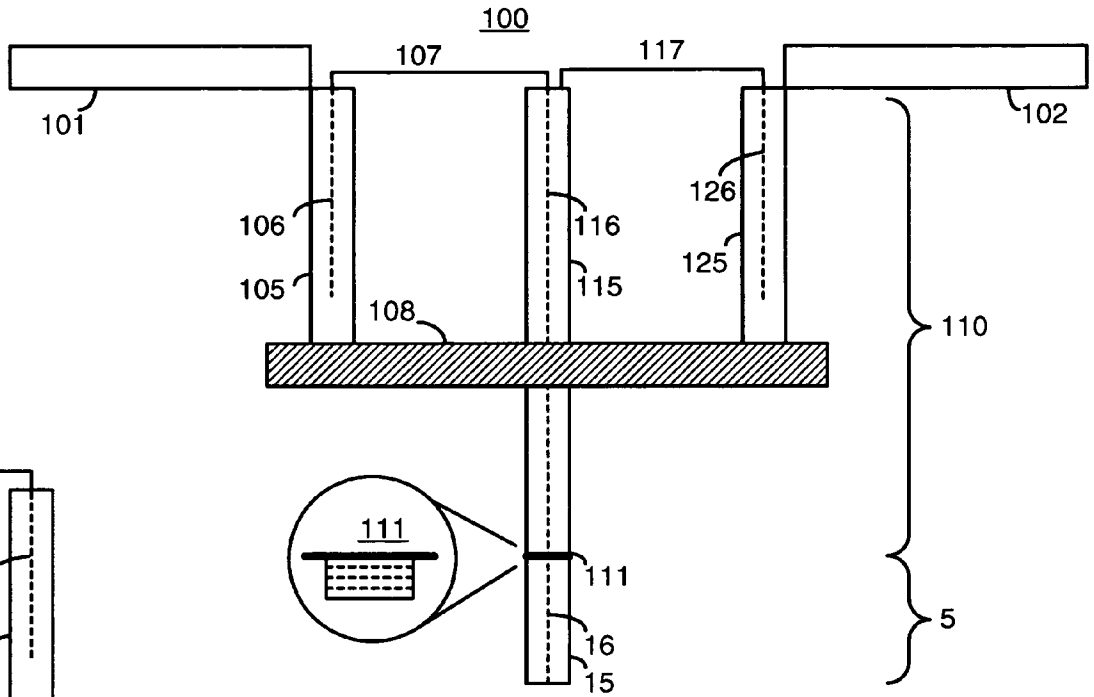
FIG. 5 is a diagram showing a coaxial cable coupled to a dipole antenna using a symmetric balun.

FIG. 5 shows balanced dipole antenna 100 having coaxial cable 5 electrically connected to a dipole antenna using symmetric balun 110. Balanced dipole antenna 100 can be tuned for use over various frequencies, for instance over the 300 MHz-1 GHz range.

The dipole antenna forms a balanced load (or source). Left dipole arm 101 and right dipole arm 102 each have a length slightly less than $\lambda/4$, where $\lambda$ is the free space wavelength of a center frequency of a bandwidth of signals being received or transmitted. Accordingly, the total length of balanced dipole antenna 100, including the width of symmetric balun 110, is about $\lambda/2$. Left and right dipole arms 101, 102 are adjustable to the correct wavelength.

Figure 6:
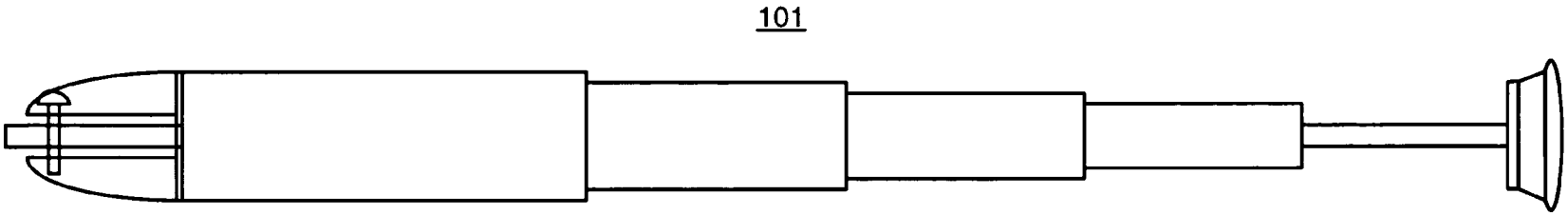
FIG. 6 is a diagram showing a telescoping dipole blade.

FIG. 6 is a diagram showing a telescoping dipole blade.

Coaxial cable 5 connects to an unbalanced source (or load) and is connected to symmetric balun 110 at connection 111 which may be a threaded screw-type connection, as shown in the circular inset of FIG. 5.

Symmetric balun 110 has a left stub having outer coaxial conductor 105 and inner coaxial conductor 106, a center feeding branch that is a coaxial cable having outer coaxial conductor 115 and inner coaxial conductor 116, and a right stub having outer coaxial conductor 125 and inner coaxial conductor 126.

Sliding bar 108 is located at the base of the left and right stubs and the center branch and electrically connects outer coaxial conductors 105, 115, 125, creating a short circuit, to provide an infinite impedance across the terminals of dipole left arm 101 and dipole right arm 102. Sliding bar 108 is adjusted so that the height of the stubs between dipole left and right arms 101, 102 and sliding bar 108 is about $\lambda 4$.

Figure 7:
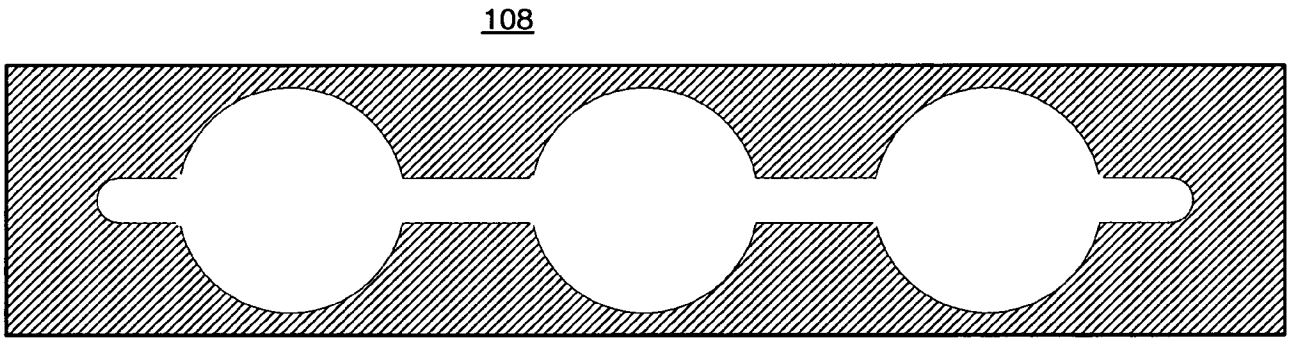
FIG. 7 is a diagram showing a sliding short circuit bar.

FIG. 7 is a diagram showing a sliding short circuit bar.

Inner coaxial conductor 116 extends from the top of the center branch to the bottom of the center branch. Connection 111 is located at the bottom of the center branch and serves to electrically connect inner coaxial conductor 116 of the center branch to inner coaxial conductor 16 of coaxial cable 5, and to electrically connect outer coaxial conductor 115 of the center branch to outer coaxial conductor 15 of coaxial cable 5.

Inner coaxial conductors 106, 126 extend from the top of the left and right stubs downwards to somewhat above the location of sliding bar 108. The height of inner coaxial conductors 106, 126 is about $\lambda_g/4$, where $\lambda_g$ is the wavelength of a center frequency of a signal being received or transmitted inside the coaxial segments of the left and right branches.

Wire 107 electrically connects inner coaxial conductor 106 of the left branch to inner coaxial conductor 116 of the center branch. Inner coaxial conductor 106 is electrically coupled to left dipole arm 101.

Wire 117 electrically connects inner coaxial conductor 126 of the right branch to outer coaxial conductor 115 of the center branch. Inner coaxial conductor 126 is electrically coupled to right dipole arm 102.

At the top exposed end of inner coaxial conductor 116, outer coaxial conductor 105 of the left stub is electrically connected to left dipole arm 101, and outer coaxial conductor 125 of the right stub is electrically connected to right dipole arm 102.

Symmetric balun 110 comprises the left and right stubs and center branch and sliding bar 108. Symmetric balun 110 is a quarter wavelength current choke.

A dipole antenna using a second embodiment of a symmetric balun according to the present invention will now be discussed.

Figure 8:
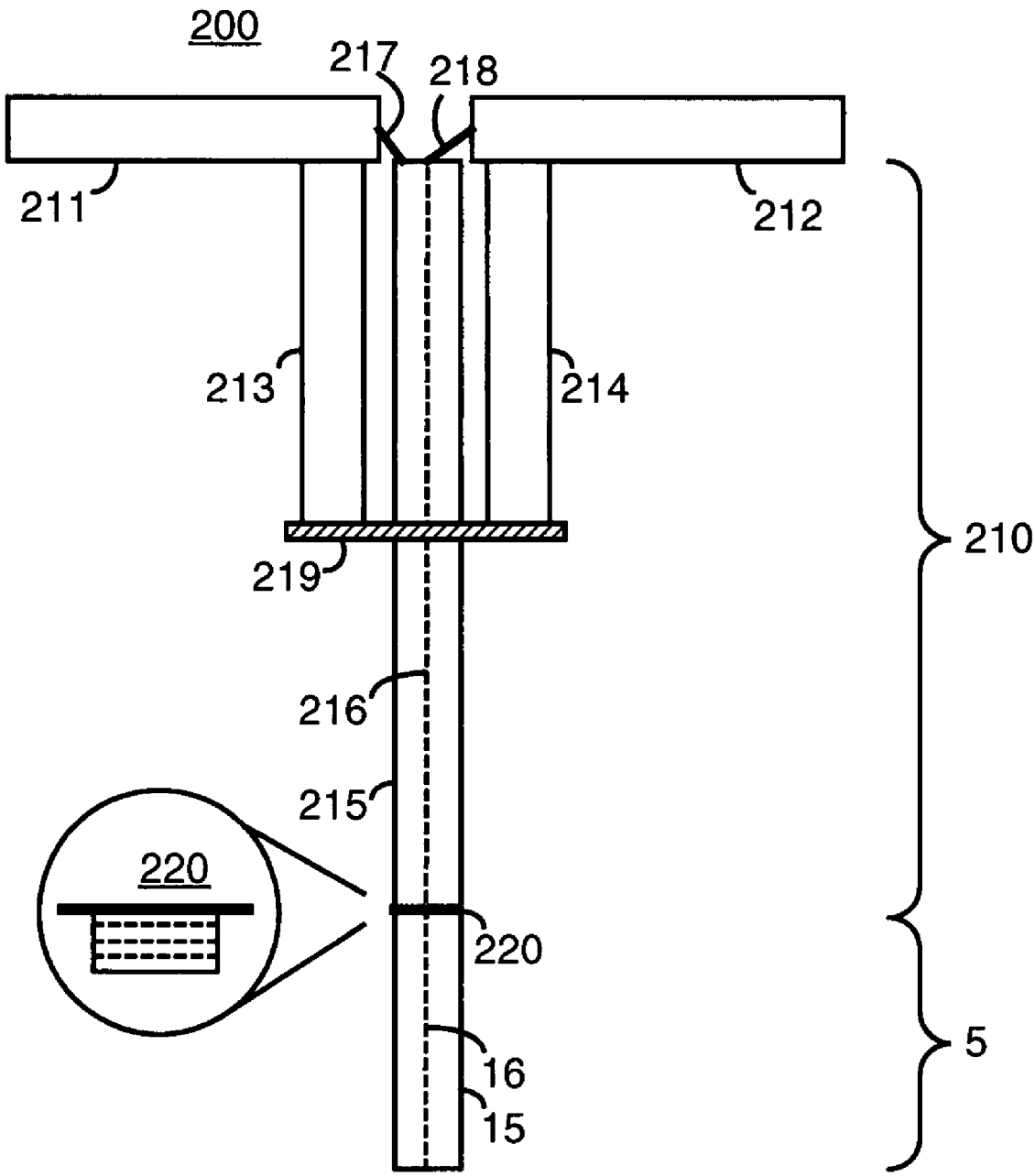
FIG. 8 is a diagram showing a coaxial cable coupled to a dipole antenna using another embodiment of a symmetric balun.

FIG. 8 is a diagram showing coaxial cable 5 electrically connected to dipole antenna 200 using symmetric balun 210. Symmetric balun 210 is similar to symmetric balun 110, except that balun 210 uses metallic stubs on either side of its center coaxial branch, whereas balun 110 uses coaxial stubs on either side of its center coaxial branch.

The dipole antenna forms a balanced load (or source). Left dipole arm 211 and right dipole arm 212 each have a length slightly less than $\lambda/4$, where $\lambda$ is the free space wavelength of a center frequency of a bandwidth of signals being received or transmitted. Accordingly, the total length of balanced dipole antenna 200, including the width of symmetric balun 210, is about $\lambda/2$. Left and right dipole arms 211, 212 are adjustable to the correct wavelength.

Conductor 217 connects left dipole arm 211 to outside shield 215 of the center branch of symmetric balun 210. Conductor 218 connects right dipole arm 212 to feeding center conductor 216 of the center branch of symmetric balun 210.

The center branch of symmetric balun 210 is electrically connected to coaxial cable 5 via connector 220, which may be a threaded screw-type connection. Center conductor 16 of coaxial cable 5 is in electrical contact with feeding center conductor 216 of the center branch. Outer shield 15 of coaxial cable 5 is electrically connected to outside shield 215 of the center branch.

Left metallic stub 213 and right metallic stub 214 each have a length of $\lambda/4$ and are respectively connected to left dipole arm 211 and right dipole arm 212.

Sliding bar 219 is located at the base of the left and right stubs and the center branch and electrically connects conductors 213, 214, 215 creating a short circuit, to provide an infinite impedance across the terminals of dipole left arm 211 and dipole right arm 212. Sliding bar 219 is adjusted so that the height of the left and right stubs between dipole left and right arms 211, 212 and sliding bar 219 is about $\lambda/4$.

To measure the effectiveness of the common mode current choke, balanced dipole antenna 200 using symmetric balun 210 with adjustable telescoping arms 211, 212 was constructed. The length of the telescoping arms 211 and the position of shorting bar 219 were adjusted to minimize the common mode current of dipole antenna 200 at the operating frequency.

Figure 1:
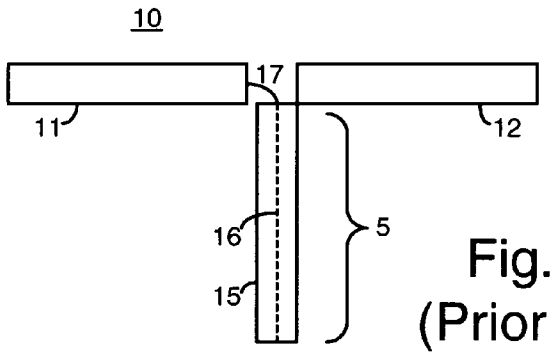
Fig. 1 (Prior Art)
FIG. 1 is a diagram showing a coaxial cable coupled directly to a prior art dipole antenna.
Figure 2:
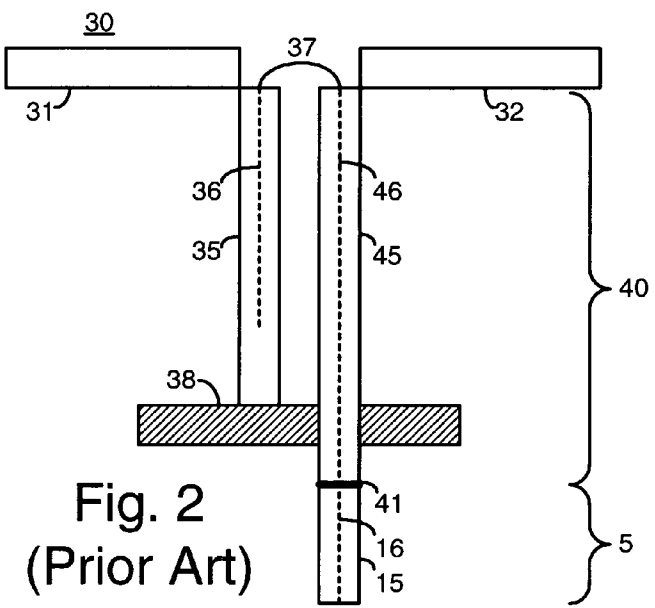
Fig. 2 (Prior Art)
FIG. 2 is a diagram showing a coaxial cable coupled to a dipole antenna using a prior art Roberts balun.
Figure 3:
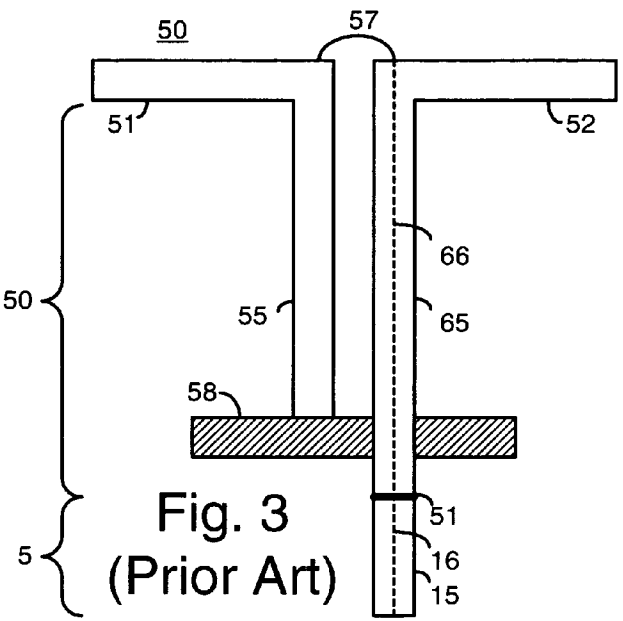
Fig. 3 (Prior Art)
FIG. 3 is a diagram showing a coaxial cable coupled to a dipole antenna using a prior art IEEE-type balun.

Dipole antenna 200 and a commercially available dipole antenna with tunable frequency according to FIG. 2 were tested in an anechoic test chamber. A horizontal-vertical measurement antenna was at one end of the chamber, at the opposite end were a horizontal dipole antenna 200 and a vertical dipole antenna 200 arranged in a cross-fashion and mounted on a supporting mast. Alternatively, a horizontal commercially available dipole antenna according to FIG. 2 and a vertical commercially available dipole antenna according to FIG. 2 were arranged in cross-fashion and mounted on a supporting mast in the chamber. The test results are shown in Table 1. The vertical and horizontal numbers represent the path loss measured in dB. The difference numbers are simply the difference between vertical path loss and horizontal path loss.

TABLE 1

| measurements | | frequency (MHz) | | | | | |
|---|---|---|---|---|---|---|---|
| are in dB | | 730 | 764 | 799 | 822 | 915 | 1000 |
| Commercially Available | Vertical | −53.7 | −51.1 | −50.5 | −50.3 | −49.2 | −49.1 |
| | Horizontal | −53.3 | −52.1 | −51.7 | −51.4 | −48.9 | −49.6 |

TABLE 1-continued

| measurements | | frequency (MHz) | | | | | |
|---|---|---|---|---|---|---|---|
| are in dB | | 730 | 764 | 799 | 822 | 915 | 1000 |
| Dipole | Difference | −0.4 | 1.0 | 1.2 | 1.1 | −0.3 | 0.5 |
| Balanced dipole 200 | Vertical | −53.1 | −51.7 | −50.2 | −50 | −47.6 | −48.5 |
| | Horizontal | −53.1 | −52.2 | −50.4 | −50.5 | −48.1 | −48.7 |
| | Difference | 0.0 | 0.5 | 0.2 | 0.5 | 0.5 | 0.2 |

Table 1 shows that balanced dipole antenna 200 has less path loss (higher gain) and less difference in vertical and horizontal path loss difference; the path loss difference is caused by the common mode current on the feeding cable. At a frequency of 750 MHz, balanced dipole antenna 200 is perfectly balanced. Table 1 demonstrates that balanced dipole antenna 200 substantially eliminates radiative coupling and common mode current.

Although an illustrative embodiment of the present invention, and various modifications thereof, have been described in detail herein with reference to the accompanying drawings, it is to be understood that the invention is not limited to this precise embodiment and the described modifications, and that various changes and further modifications may be effected therein by one skilled in the art without departing from the scope or spirit of the invention as defined in the appended claims.

What is claimed is:

1. A balanced dipole antenna, comprising: a left dipole arm having a center end, a right dipole arm having a center end, a coaxial cable having an outer conductor and a single inner conductor and a top end electrically located between the center ends of the left and right dipole arms, a left stub connected to the left dipole arm and unconnected to the inner conductor of the coaxial cable, and a right stub connected to the right dipole arm and unconnected to the inner conductor of the coaxial cable, wherein one of the left and right dipole arms is electrically connected to the inner conductor of the coaxial cable, and the other of the left and right dipole arms is electrically connected to the outer conductor of the coaxial cable.

2. The balanced dipole antenna of claim 1, wherein the left and right stubs are formed of metallic material.

3. The balanced dipole antenna of claim 1, further comprising a bar that electrically connects the left stub, the right stub and the coaxial cable.

4. The balanced dipole antenna of claim 3, wherein the bar is slidable along the coaxial cable.

5. The balanced dipole antenna of claim 1, wherein the length of the left and fight dipole arms is adjustable.

6. The balanced dipole antenna of claim 1, wherein the length of the left and right dipole arms is slightly less than $\lambda/4$, where $\lambda$ is the free space wavelength of a center frequency of a signal being received or transmitted.

7. The balanced dipole antenna of claim 1, wherein the height of the left and right stubs is about $\lambda/4$, where $\lambda$ is the free space wavelength of a center frequency in a bandwidth of signals being received or transmitted.

8. The balanced dipole antenna of claim 1, wherein the left and right stubs substantially eliminate radiative coupling between the coaxial cable and the left and right dipole arms.

9. The balanced dipole antenna of claim 1, wherein the left and right stubs substantially eliminate common mode current between the coaxial cable and the left and right dipole arms.

10. A symmetric balun, comprising: a center branch for connecting to a coaxial cable, the center branch having an inner conductor and an outer conductor, a left stub for coupling to a left arm of a dipole antenna and unconnected to the inner conductor of the coaxial cable, a right stub for coupling to a right arm of the dipole antenna and unconnected to the inner conductor of the coaxial cable, a first wire for electrically connecting one of the left and right arms of the dipole antenna to the inner conductor of the coaxial cable, and a second wire for electrically connecting the other of the left and right arms of the dipole antenna to the outer conductor of the coaxial cable.

11. The symmetric balun of claim 10, wherein the left and fight stubs are formed of metallic material.

12. The symmetric balun of claim 10, further comprising a bar at the base of the left and right stubs and the center branch for electrically connecting the left and fight stubs and the center branch.

13. The symmetric balun of claim 12, wherein the bar is slidable along the length of the left and right stubs.

14. The symmetric balun of claim 10, further comprising a connector for connecting the center branch to a coaxial cable.

15. The symmetric balun of claim 10, wherein the height of the left and right stubs is about $\lambda/4$, where $\lambda$ is the free space wavelength of a center frequency in a bandwidth of signals being received or transmitted.

16. The symmetric balun of claim 10, wherein the left and right stubs substantially eliminate radiative coupling between the coaxial cable and the left and right dipole arms.

17. The symmetric balun of claim 10, wherein the left and right stubs substantially eliminate common mode current between the coaxial cable and the left and right dipole arms.

* * * * *